US006666241B1

(12) United States Patent
Lee

(10) Patent No.: US 6,666,241 B1
(45) Date of Patent: Dec. 23, 2003

(54) WOOD PLANING DEVICE FOR A WOOD PLANING MACHINE

(75) Inventor: Yu-Shu Lee, Taichung (TW)

(73) Assignee: P & F Brother Industrial Corporation, Taichung (TW)

( * ) Notice: Subject to any disclaimer, the term of this patent is extended or adjusted under 35 U.S.C. 154(b) by 0 days.

(21) Appl. No.: 10/310,258

(22) Filed: Dec. 4, 2002

(51) Int. Cl.[7] ..... B27C 1/02

(52) U.S. Cl. ..... 144/117.1; 144/130; 74/22 R; 74/27; 74/63

(58) Field of Search ..... 74/89.17, 22 A, 74/27–34, 63–473.1; 144/114.1, 117.1, 129, 130; 451/9, 296

(56) References Cited

U.S. PATENT DOCUMENTS 4,422,486 A * 12/1983 Maret ..... 144/117.1
5,957,173 A * 9/1999 Garcia ..... 144/117.1
6,089,286 A * 7/2000 Liao ..... 144/130
6,516,684 B1 * 2/2003 Chang ..... 144/130

* cited by examiner

*Primary Examiner*—W. Donald Bray
(74) *Attorney, Agent, or Firm*—Jeffrey D. Myers

(57) ABSTRACT

A wood planing device includes a support carriage movably mounted on a wood planing machine, and a rotatable shaft rotatably mounted on the carriage and having a coupling segment. A coupling sleeve surrounds the shaft and is movable between engaging and disengaging positions to engage and disengage the shaft. A rolling member is driven to rotate by a rotational force from the coupling sleeve to feed-in a workpiece supported on the machine. A clutch member is disposed to connect the coupling sleeve and a reduction gear train when the coupling sleeve is in the disengaging position. As such, the rolling member can be rotated by a first rotational drive delivered by the shaft through the coupling sleeve at a high speed, or by a second rotational drive through the clutch member and the reduction gear train at a low speed.

8 Claims, 11 Drawing Sheets

WOOD PLANING DEVICE FOR A WOOD PLANING MACHINE

BACKGROUND OF THE INVENTION

1. Field of the Invention

This invention relates to a wood planing device for a wood planing machine, more particularly to a wood planing device with a feeding rolling member capable of rotation at two different speeds.

2. Description of the Related Art

Referring to FIG. 1, a conventional wood planing machine 10 is shown to include a mounting frame 11 with two pairs of upright posts 13 at right and left sides thereof, respectively, a worktable 111 which is mounted at a bottom of the mounting frame 11, and a support carriage 12 which is movable upwardly and downwardly relative to the worktable 111 by operating a handle 15 to rotate a threaded bolt 14. A rotatable shaft 121 is rotatably mounted on a lower end of the support carriage 12, and is driven by a motor (not shown). Feed-in and take-out rollers 122 are mounted on the lower end of the support carriage 12 in front of and behind the rotatable shaft 121, respectively. A drive transmitting mechanism (not shown) is disposed to transmit a rotational force of the rotatable shaft 121 to the rollers 122 for feeding-in and taking-out of a workpiece supported on the worktable 111.

Since the rotational speed of the rollers 122 is fixed, the workpiece is fed at a fixed speed, thereby resulting in inconvenience during a planing operation. For example, when it is desired to plane the workpiece to a smooth surface, the feeding operation of the workpiece through the rollers 122 has to be repeated many times, thereby increasing the operating cost.

SUMMARY OF THE INVENTION

The object of the present invention is to provide a wood planing device which can shift the feeding speed of a workpiece to meet planing requirements.

According to this invention, the wood planing device includes a support carriage having right and left carriage sides which are adapted to be mounted respectively on right and left sides of a mounting frame of a wood planing machine and above a worktable. The support carriage is movable in an upright direction. A rotatable shaft is mounted on the support carriage and is driven to be rotatable about a first axis in a longitudinal direction. The rotatable shaft has a driving segment and an outer surrounding coupling segment which are disposed proximate to the left and right carriage sides, respectively. A rolling member is mounted rotatably on the right and left carriage sides, and extends in the longitudinal direction to be rotatable about a second axis parallel to the first axis. A coupling sleeve surrounds the rotatable shaft and is rotatable about the first axis. The coupling sleeve has an inner surrounding coupling segment which is sleeved on the rotatable shaft, and is shiftable along the first axis between an engaging position, where the inner surrounding coupling segment engages the outer surrounding coupling segment such that the coupling sleeve is rotated by the rotatable shaft with a first rotational drive, and a disengaging position, where the inner surrounding coupling segment disengages from the outer surrounding coupling segment. A reduction gear train includes a driving gear which surrounds and which rotates with the driving segment about the first axis, and a driven gear which surrounds the first axis and which is disposed downstream of the driving gear and adjacent to the coupling sleeve to deliver a reduction drive as a result of drive transmission from the driving gear to the driven gear. A clutch member is disposed to connect the coupling sleeve and the driven gear when the coupling sleeve is in the disengaging position so as to drive the coupling sleeve to rotate about the first axis with a second rotational drive, and is disposed to disconnect the coupling sleeve and the driven gear when the coupling sleeve is in the engaging positions. A drive delivering sleeve has a spline segment which is disposed to be in spline engagement with the coupling sleeve, and a delivering segment which is disposed distal from the coupling sleeve. The drive delivering sleeve is sleeved on and is rotatable relative to the rotatable shaft about the first axis such that the first and second rotational forces are delivered through the spline segment to rotate the delivering segment about the first axis. A drive transmitting member is disposed to transmit a rotational force of the delivering segment to the rolling member. A shifting member is disposed to shift the coupling sleeve between the engaging and disengaging positions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
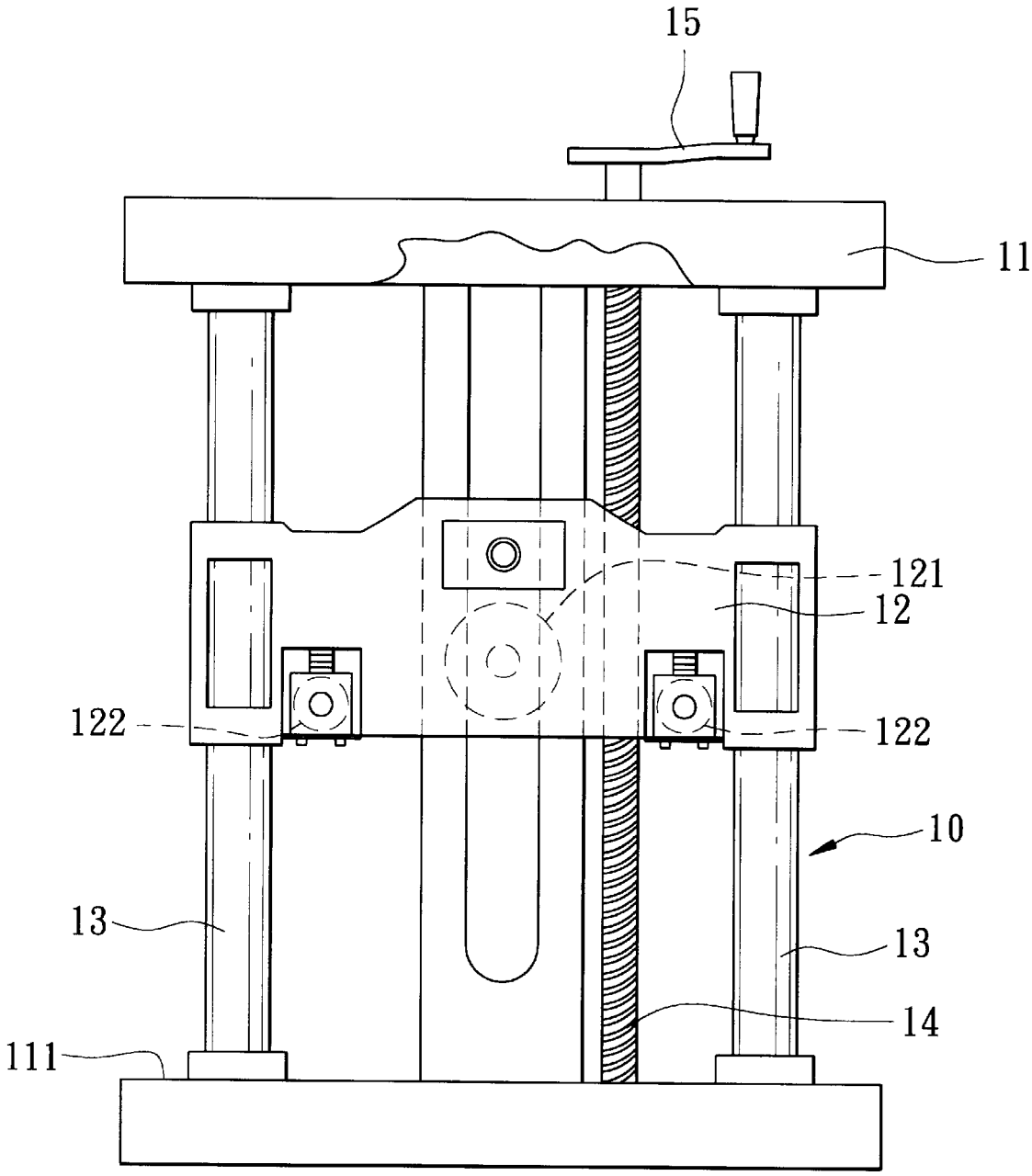
FIG. 1 PRIOR ART
FIG. 1 is a schematic side view of a conventional wood planing machine.
Figure 2:
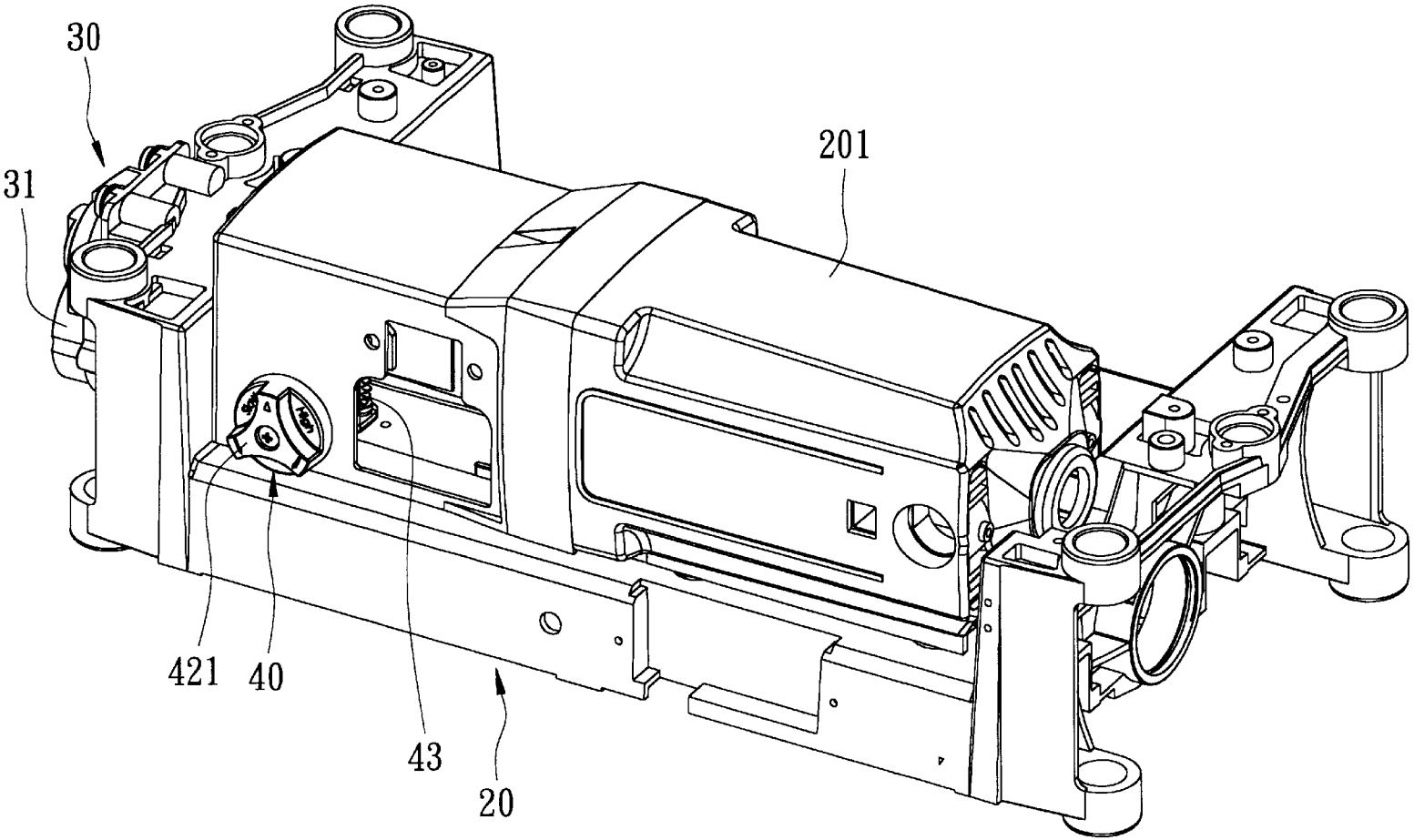
FIG. 2 is a perspective view of a preferred embodiment of a wood planing device according to this invention.
Figure 3:
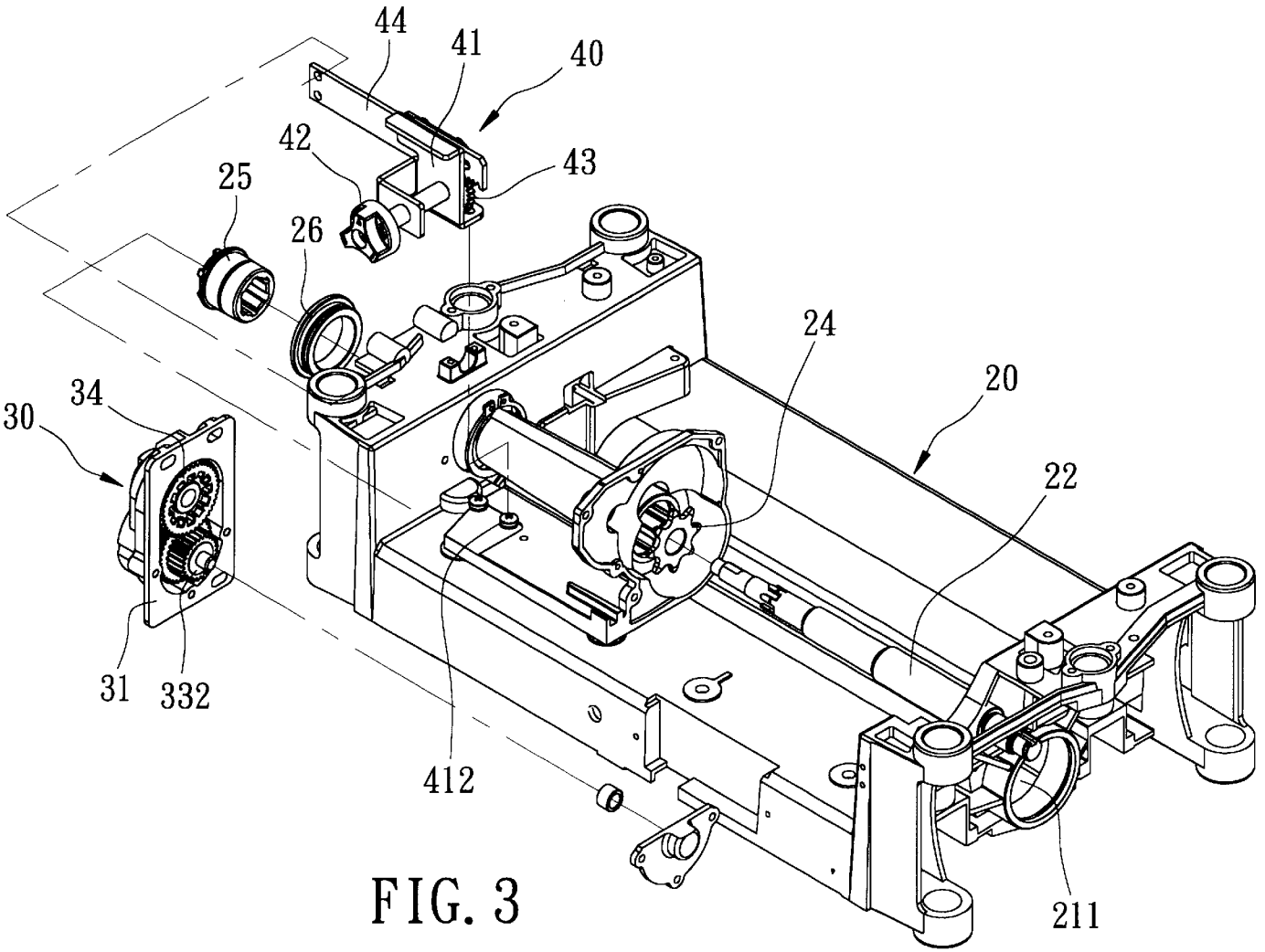
FIG. 3 is an exploded perspective view of the preferred embodiment.

The preferred embodiment of a wood planing device according to the present invention is adapted to be mounted on a mounting frame (not shown) of a known wood planing machine (not shown). The mounting frame has right and left sides which are spaced apart from each other in a longitudinal direction. A worktable (not shown) is mounted between the right and left sides of the mounting frame for supporting a workpiece thereon, and has feed-in and take-out sides opposite to each other in a transverse direction relative to the longitudinal direction. Referring to FIGS. 2 and 3, the wood planing device of this embodiment is shown to comprise a support carriage 20, a reduction gear train 30, and a shifting member 40.

The support carriage 20 has right and left carriage sides which are adapted to be mounted respectively on the right and left sides of the mounting frame and above the worktable, and is movable in an upright direction transverse to the longitudinal and transverse directions relative to the worktable. A motor 201 is mounted on the support carriage 20 proximate to the right carriage side. The support carriage 20 has an accommodation chamber 211 which is formed at a center thereof for accommodating a cutting shaft (not shown) that is driven by the motor 201.

Figure 4:
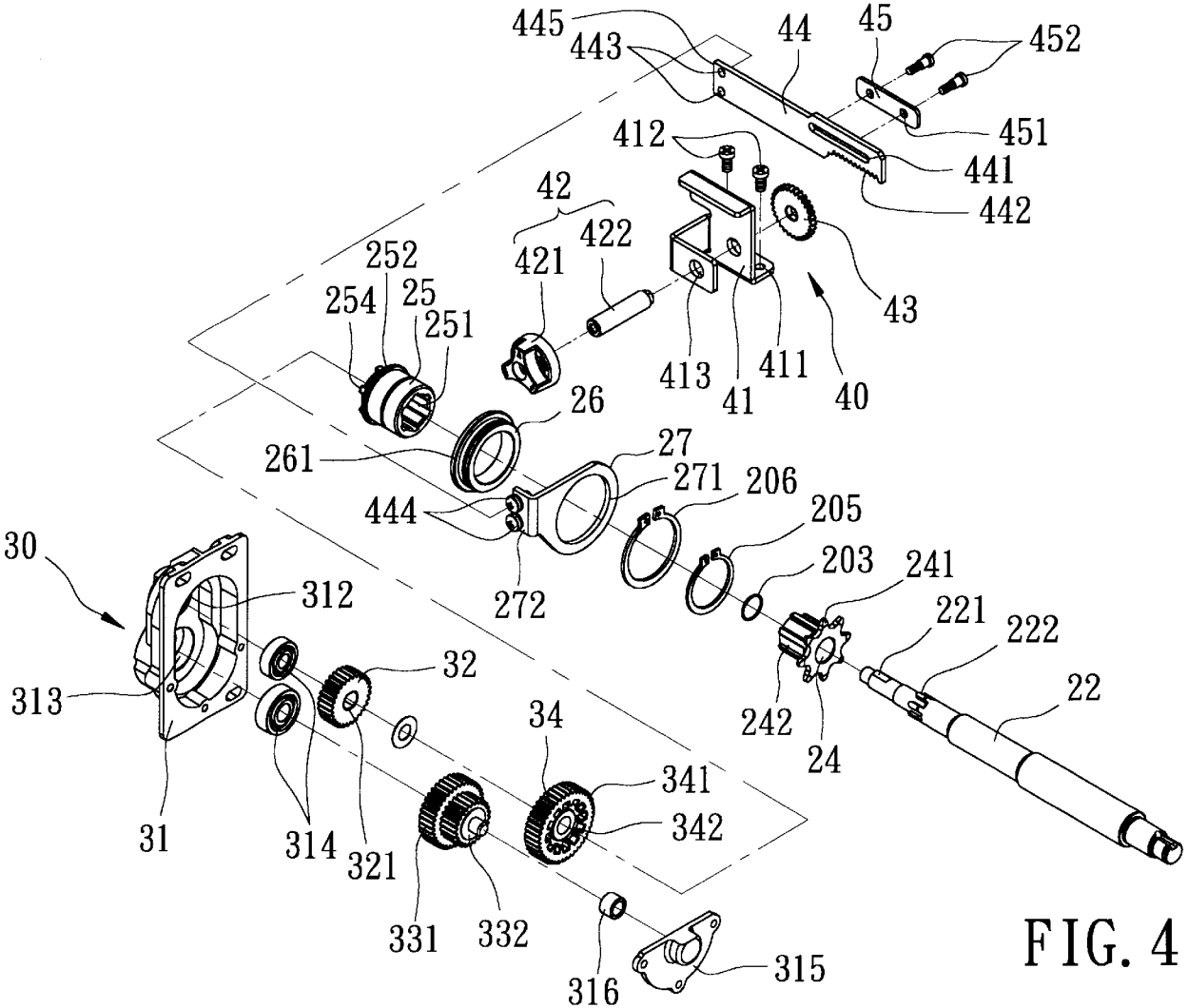
FIG. 4 is an exploded perspective view of the preferred embodiment, with a support carriage and a rolling member thereof removed for the sake of clarity.
Figure 5:
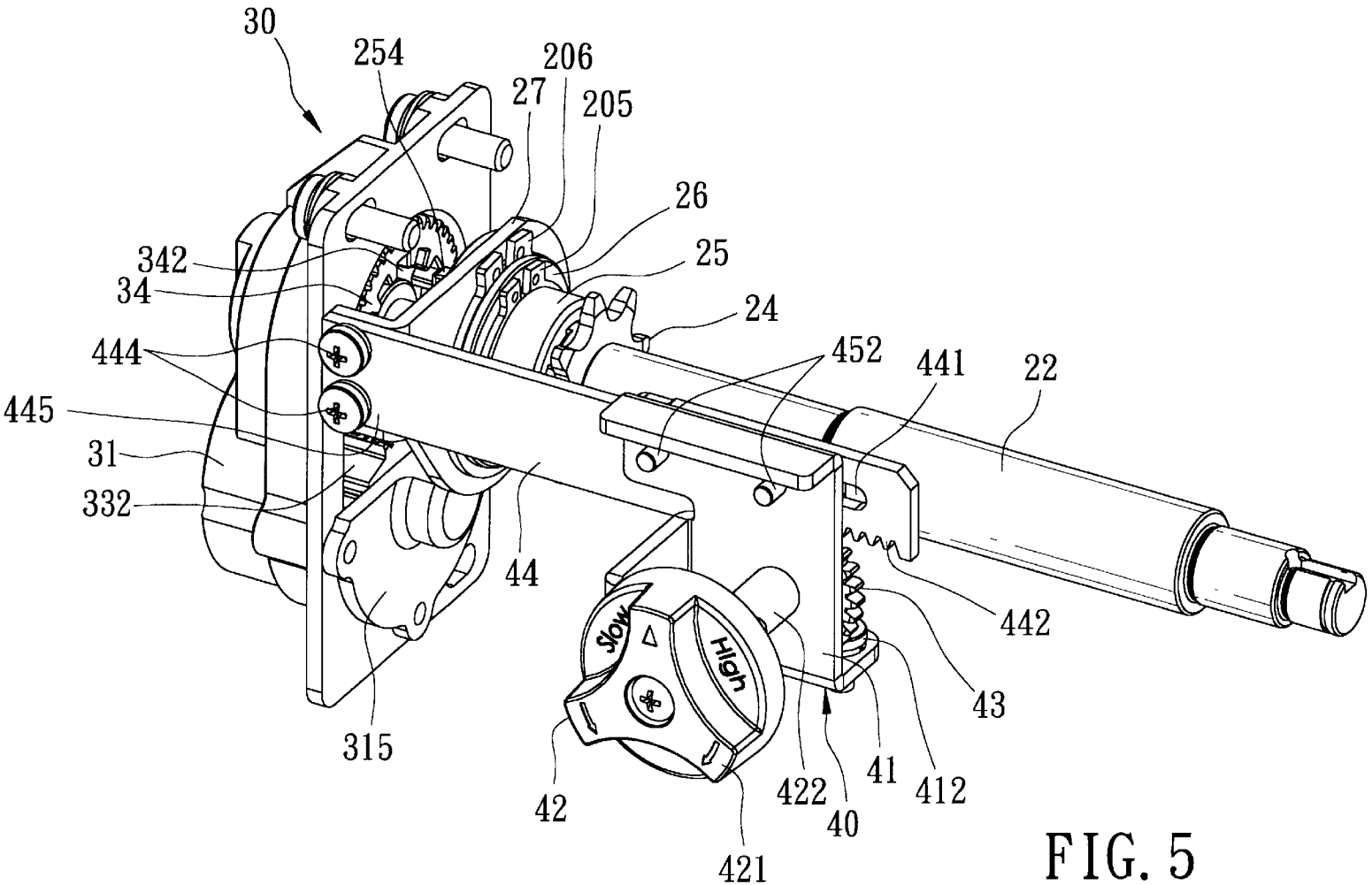
FIG. 5 is a perspective view showing the component parts of the preferred embodiment in FIG. 4.
Figure 6:
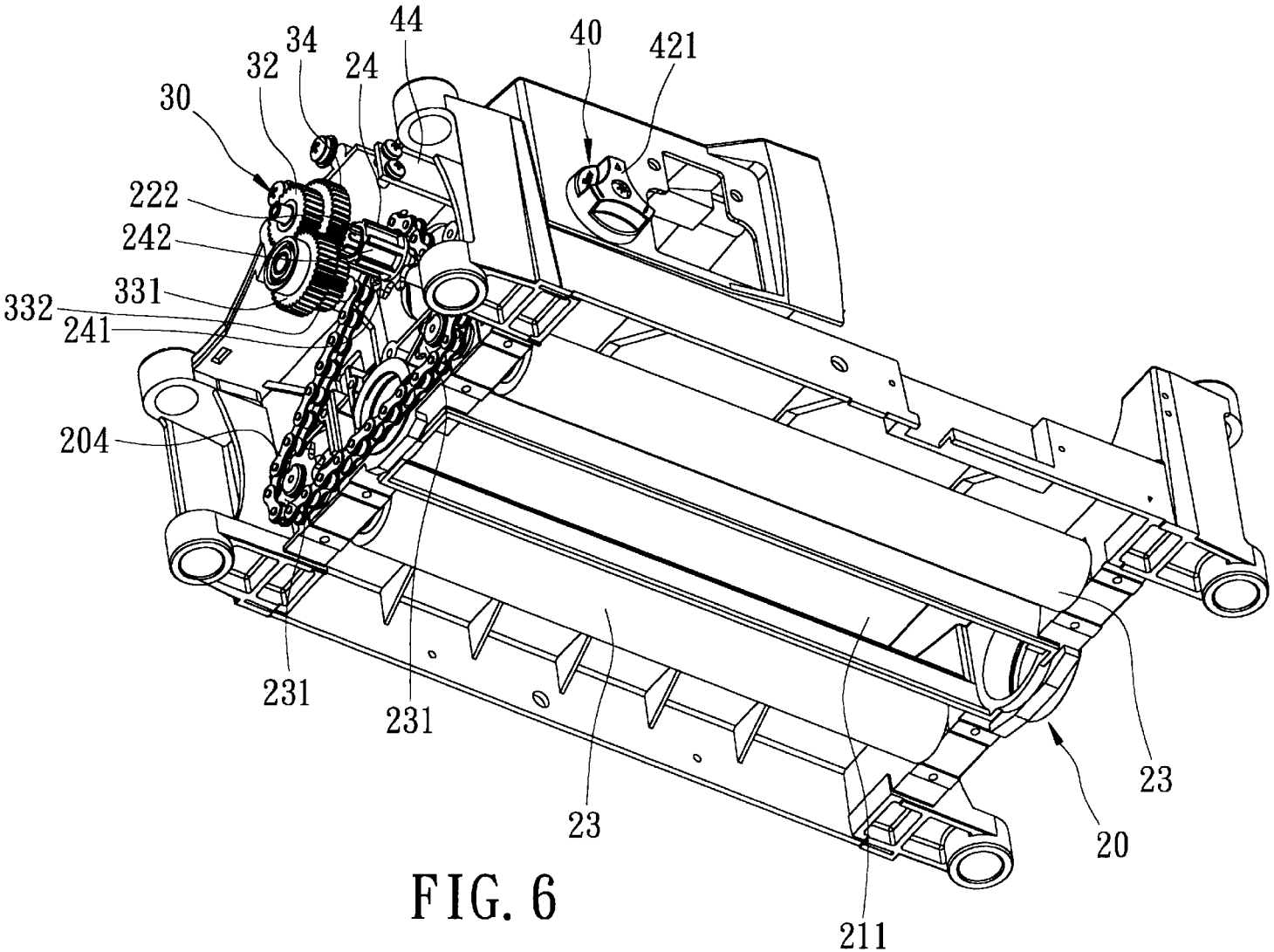
FIG. 6 is a perspective view of the preferred embodiment taken from a bottom side.

With reference to FIGS. 4 and 5, a rotatable shaft 22 is mounted on the support carriage 20, and is driven by the motor 201 in a known manner to be rotatable about a first axis in the longitudinal direction. The rotatable shaft 22 has a driving segment 221 of a non-circular shape and an outer surrounding coupling segment 222 in form of teeth, which are disposed proximate to the left and right carriage sides, respectively. As shown in FIG. 6, a rolling member includes feed-in and take-out rollers 23 which are mounted rotatably on the right and left carriage sides proximate to the feed-in and take-out sides of the worktable, respectively, and which extend in the longitudinal direction to be rotatable about second axes that are parallel to the first axis.

Figure 8:
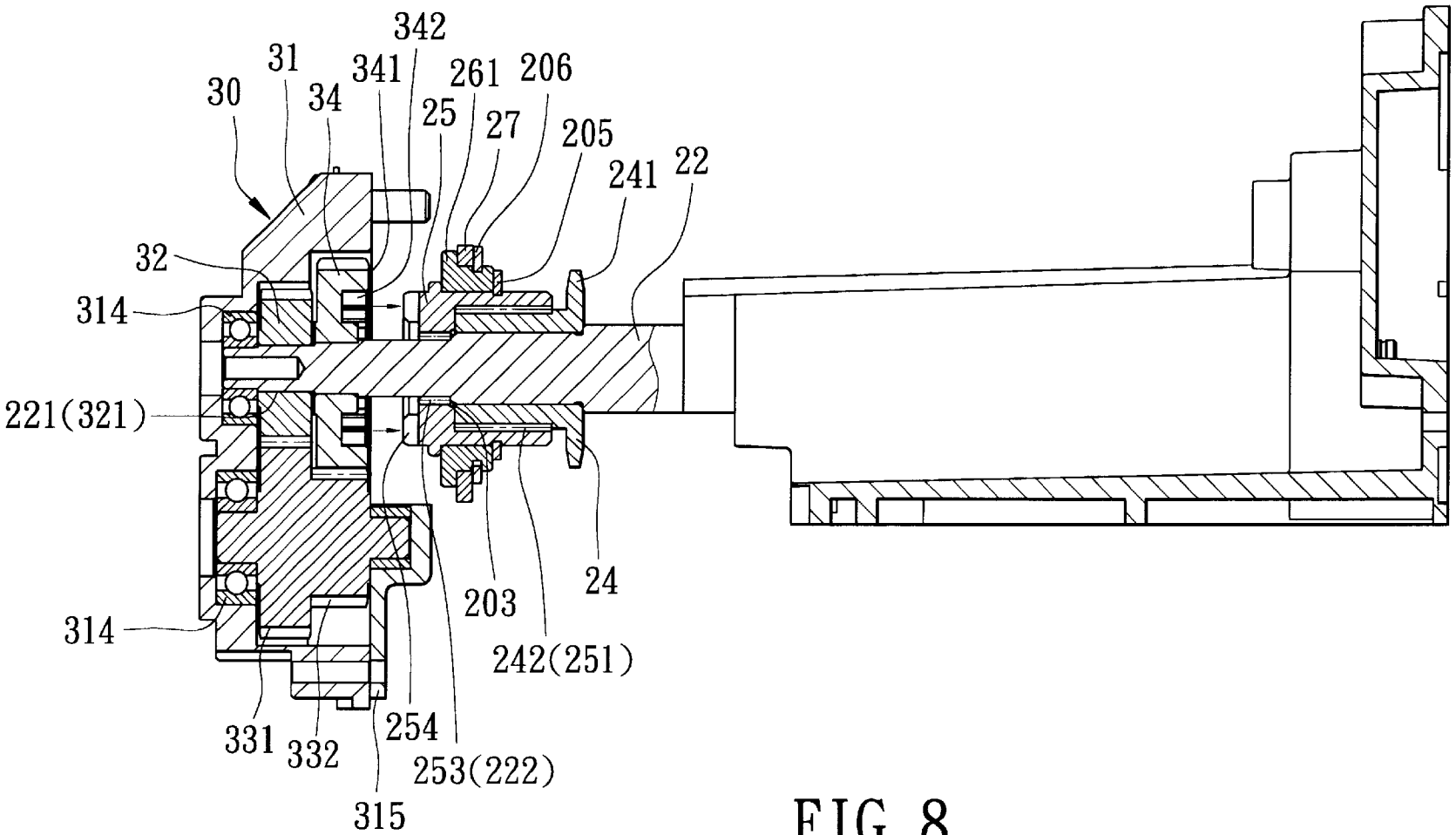
FIG. 8 is a sectional view showing the preferred embodiment in a high-speed state.

A drive delivering sleeve 24 is sleeved on and is rotatable relative to the rotatable shaft 22 about the first axis, and is prevented from moving in the longitudinal direction relative to the rotatable shaft 22 by means of a ring 203. The drive delivering sleeve 24 has a spline segment 242 and a delivering segment 241 in form of chain teeth, which are disposed opposite to each other and proximate to and distal from the outer surrounding coupling segment 222, respectively, as shown in FIG. 8.

With reference to FIG. 6, a drive transmitting member includes two chain wheels 231 which are disposed on and which are rotated with left ends of the feed-in and take-out rollers 23, respectively, and a chain 204 which is trained on the delivering segment 241 of the drive delivering sleeve 24 and the chain wheels 231 so as to transmit a rotational force of the drive delivering sleeve 24 to the feed-in and take-out rollers 23.

A coupling sleeve 25 surrounds the rotatable shaft 22 and is rotatable about the first axis. The coupling sleeve 25 has an inner surrounding splining segment 251 which is in spline engagement with the spline segment 242 of the drive delivering sleeve 24, an inner surrounding coupling segment 253 which is disposed opposite to the inner surrounding splining segment 251 in the longitudinal direction and which is movable along the first axis between an engaging position, as shown in FIG. 8, where the inner surrounding coupling segment 253 engages the outer surrounding coupling segment 222 of the rotatable shaft 22 such that the coupling sleeve 25 is rotated directly by the rotatable shaft 22 with a first rotational drive, thereby resulting in simultaneous rotation of the drive delivering sleeve 24 and the feed-in and take-out rollers 23, and a disengaging position, as shown in FIG. 10, where the inner surrounding coupling segment 253 disengages from the outer surrounding coupling segment 222.

The reduction gear train 30 includes a driving gear 32 with a coupling portion 321 which surrounds and which rotates with the driving segment 221 of the rotatable shaft 22 about the first axis, a driven gear 34 which surrounds the first axis and which is disposed downstream of the driving gear 32 and adjacent to the coupling sleeve 25, and a larger gear 331 and a smaller gear 332 which are coupled coaxially to each other along a third axis that is parallel to the first axis and which are meshed with the driving gear 32 and the driven gear 34, respectively, so as to result in a reduction drive that is delivered from the driving gear 32 to the driven gear 34. In assembling the reduction gear train 30, a support member 31 is secured on the left carriage side of the support carriage 20, and has first and second bearing seats 312,313 disposed opposite to each other in the upright direction. The driving and driven gears 32,34 are rotatably accommodated in the first bearing seat 312 by a bearing 314. The larger and smaller gears 331, 332 are rotatably accommodated in the second bearing seat 313 by a bearing 314. A bearing seat plate 315 has a bearing 316 mounted therein and is secured on the support member 31 to cover the second bearing seat 313.

Figure 10:
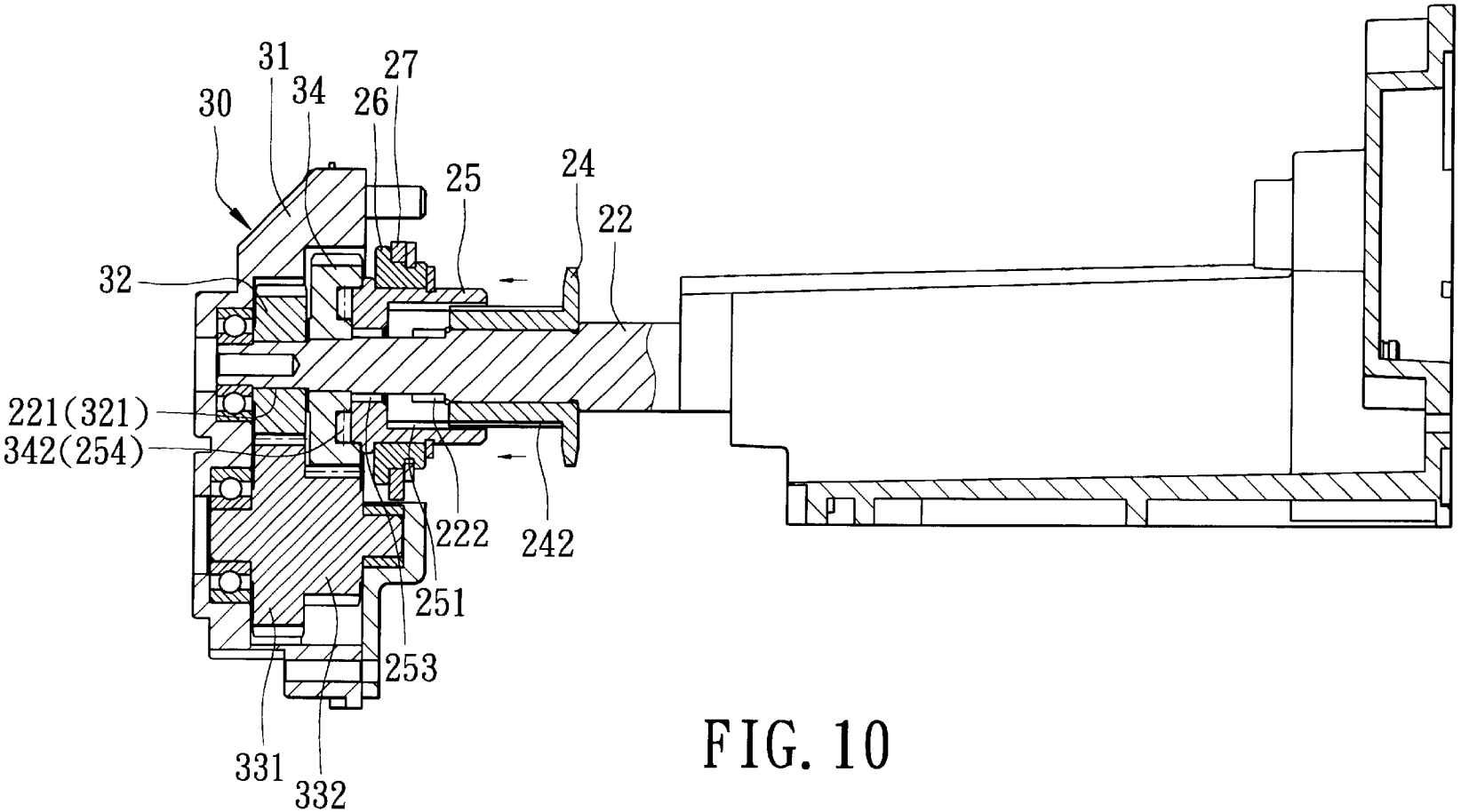
FIG. 10 is a sectional view showing the preferred embodiment in a low-speed state.

Referring to FIGS. 4, 8 and 10, a clutch member includes a plurality of engaging protrusions 254 which are formed on an end wall 252 of the coupling sleeve 25 and which extend away from the inner surrounding splining segment 251 in the longitudinal direction, and a plurality of engaging recesses 342 which are formed in an end wall 341 of the driven gear 34 and which confront the engaging protrusions 254 so as to engage retainingly the engaging protrusions 254 when the coupling sleeve 25 is in the disengaging position, as shown in FIG. 10. In this position, the driven gear 34 is coupled with the coupling sleeve 25 so as to drive the coupling sleeve 25 to rotate about the first axis with a second rotational drive for simultaneous rotation of the drive delivering sleeve 24 and the feed-in and take-out rollers 23. On the contrary, when the coupling sleeve 25 is in the engaging position as shown in FIG. 8, the coupling sleeve 25 is disconnected from the driven gear 34. As such, the delivering segment 241 is rotated by the first or second rotational drive that is delivered through the drive delivering sleeve 24 via the coupling sleeve 25 so as to rotate the rollers.

With reference to FIGS. 3 to 5, the shifting member 40 includes a rack 41, an actuating unit 42, and a cam unit. The rack 41 is secured on the support carriage 20 by engagement of screws 412 and holes 411. The actuating unit 42 has a shaft-shaped inner actuating end 422 which rotatably extends through a hole 413 in the rack 41 about an operating axis that is radial to the first axis of the rotatable shaft 22, and an outer operating end 421 in form of a knob which extends from the inner actuating end 422 along the operating axis and outwardly of the support carriage 20 so as to be externally operable to rotate the inner actuating end 422 with a rotating force.

Figure 7:
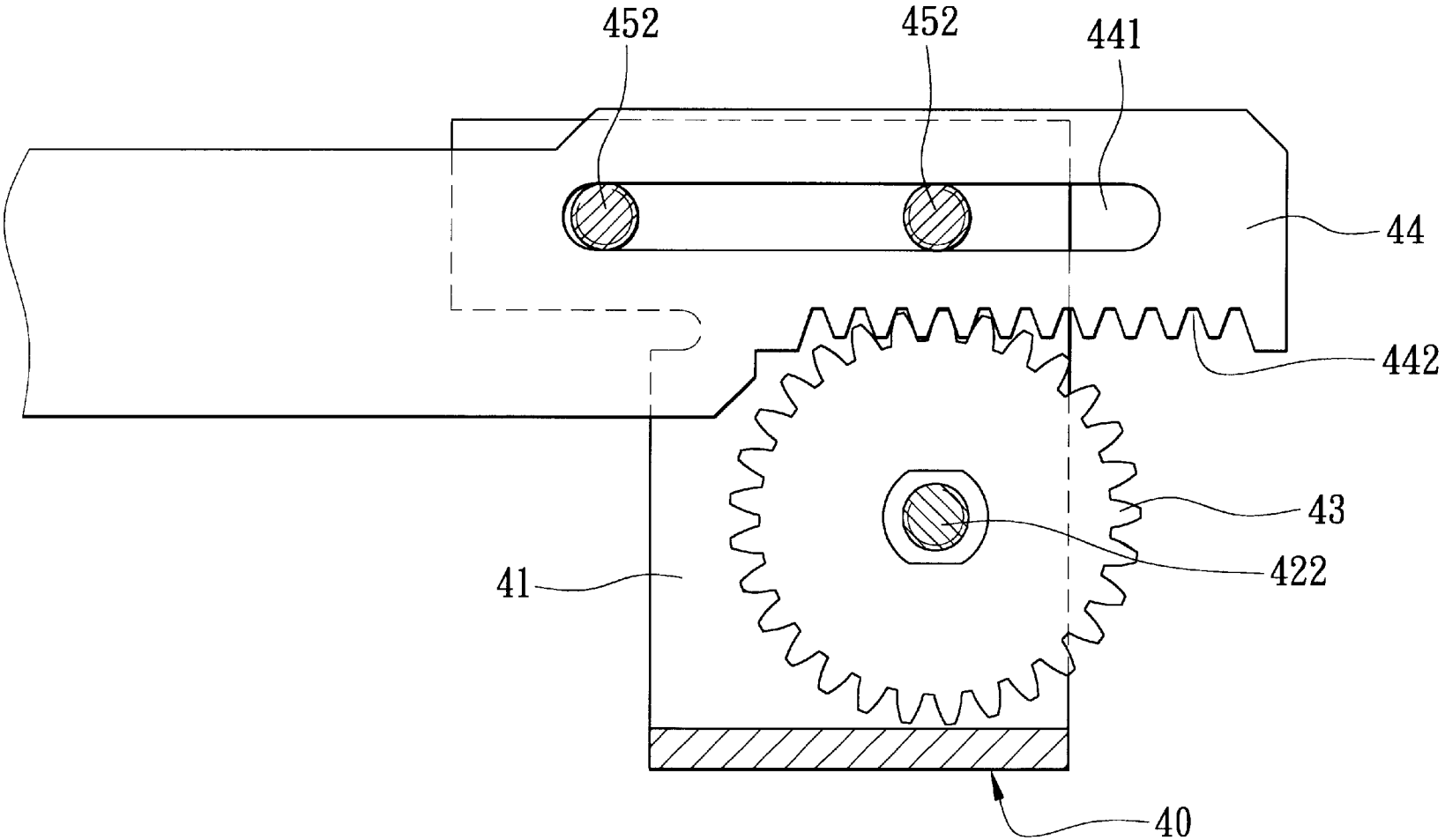
FIG. 7 is a schematic view showing a portion of a shifting member according to this preferred embodiment.

The cam unit includes a driving pinion 43 which is rotated with the inner actuating end 422 about the operating axis, a transmission lever 44 which has a rack segment 442 that is meshed with the driving pinion 43 to move the transmission lever 44 in the longitudinal direction when the driving pinion 43 is rotated with the inner actuating end 422, and a connecting end 445 which is disposed opposite to the rack segment 442 in the longitudinal direction, and a coupler. The coupler includes a connecting ring 26 which is sleeved securely on the coupling sleeve 25 by means of a C-shaped snap 205, a flange 261 which is disposed to extend outwardly and radially from the connecting ring 26, and an actuated plate 27 which has a sleeve end 271 that is sleeved on the connecting ring 26 and that abuts against the flange 261 in the longitudinal direction by means of a C-shaped snap 206, and a coupling end 272 which extends from the sleeve end 271 in a direction radial to the first axis and which is secured to the connecting end 445 of the transmission lever 44 by engagement of screws 444 and holes 443 so as to couple with the connecting end 445 of the transmission lever 44. Preferably, as shown in FIG. 7, the transmission lever 44 further has an elongated guiding slot 441 adjacent to the rack segment 442. A guiding plate 45 is secured on the rack 41 by screws 452 that pass through holes 451 in the guiding plate 45 and the slot 441 for guiding movement of the transmission lever 44.

Thus, by virtue of the rotation of the actuating unit 42, the transmission lever 44 is moved in the longitudinal direction so as to move the coupling sleeve 25 along the first axis between the engaging and disengaging positions.

Figure 9:
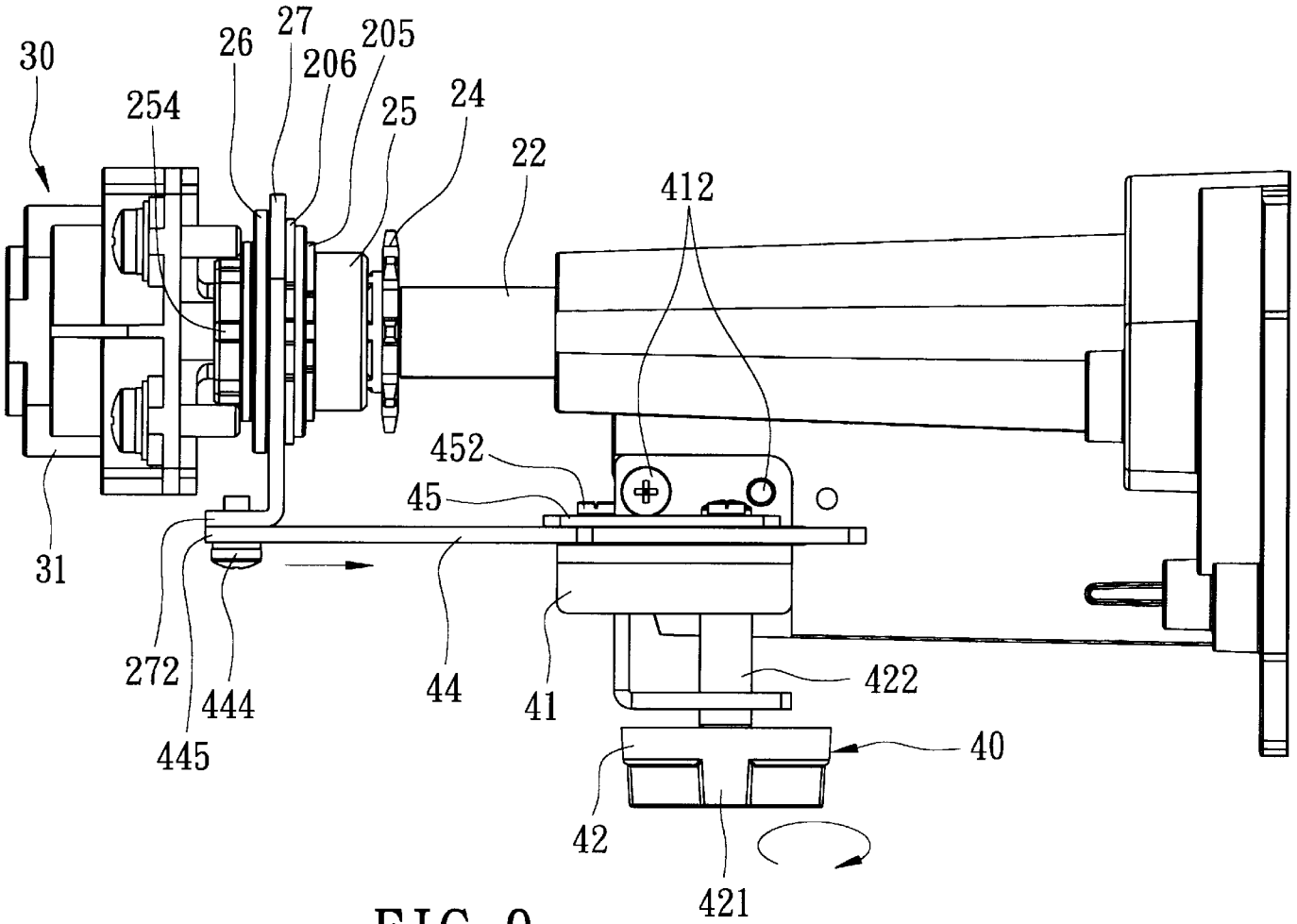
FIG. 9 is a top schematic view showing the preferred embodiment in the high-speed state.

When it is desired to feed a workpiece at a high speed, as shown in FIGS. 8 and 9, the knob-shaped outer operating end 421 is turned clockwise (see FIG. 9) to move the coupling sleeve 25 rightward to the engaging position, where the inner surrounding coupling segment 253 meshes with the outer surrounding coupling segment 222, such that the coupling sleeve 25 is rotated by the first rotational drive of the rotatable shaft 22 and such that the feed-in and take-out rollers 23 are rotated by the drive delivering sleeve 24 and the drive transmitting member.

Figure 11:
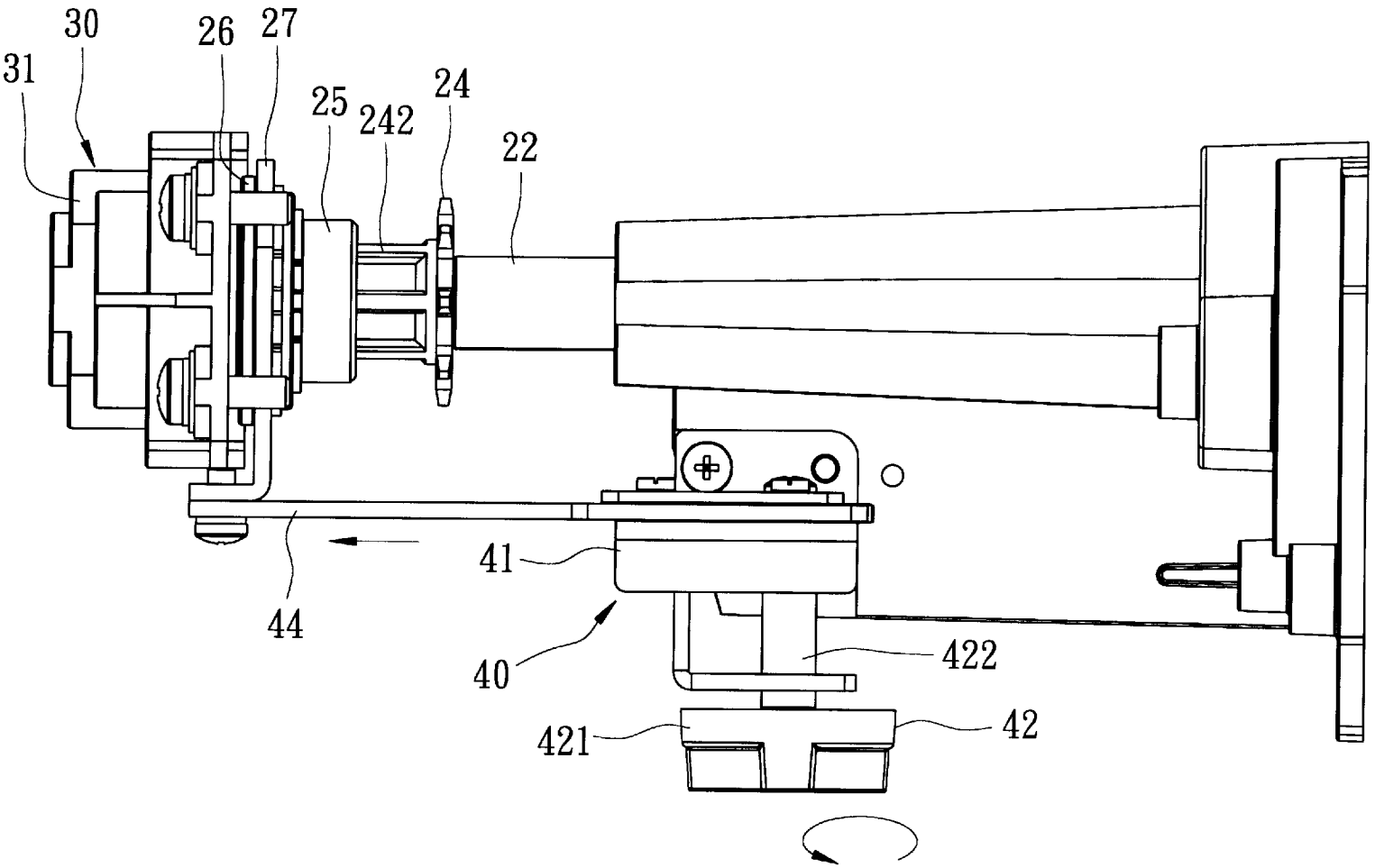
FIG. 11 is a schematic top view showing the preferred embodiment in the low-speed state.

When it is desired to feed a workpiece at a low speed, as shown in FIGS. 10 and 11, the knob-shaped outer operating end 421 is turned counterclockwise (see FIG. 11) to move the coupling sleeve 25 leftward to the disengaging position, where the inner surrounding coupling segment 253 disengages from the outer surrounding coupling segment 222 and where the engaging protrusions 254 engage retainingly the engaging recesses 342, such that the coupling sleeve 25 is rotated by the second rotational drive generated by the reduction drive of the reduction gear train 30 and such that the feed-in and take-out rollers 23 are rotated by the drive delivering sleeve 24 and the drive transmitting member.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A wood planing device for a wood planing machine, the wood planing machine including a mounting frame which has right and left sides spaced apart from each other in a longitudinal direction, and a worktable which is mounted between the right and left sides of the mounting frame for supporting a workpiece thereon and which has feed-in and take-out sides opposite to each other in a transverse direction relative to the longitudinal direction, said wood planing device comprising:

a support carriage having right and left carriage sides which are adapted to be mounted respectively on the right and left sides of the mounting frame and above the worktable, and movable in an upright direction transverse to the longitudinal and transverse directions;

a rotatable shaft mounted on said support carriage and driven to be rotatable about a first axis in the longitudinal direction, said rotatable shaft having a driving segment and an outer surrounding coupling segment which are disposed proximate to said left and right carriage sides, respectively;

a rolling member mounted rotatably on said right and left carriage sides, and extending in the longitudinal direction to be rotatable about a second axis parallel to the first axis;

a coupling sleeve surrounding said rotatable shaft and rotatable about the first axis, said coupling sleeve having an inner surrounding coupling segment which is sleeved on said rotatable shaft, and being shiftable along the first axis between an engaging position, where said inner surrounding coupling segment engages said outer surrounding coupling segment such that said coupling sleeve is rotated by said rotatable shaft with a first rotational drive, and a disengaging position, where said inner surrounding coupling segment disengages from said outer surrounding coupling segment;

a reduction gear train including a driving gear which surrounds and which rotates with said driving segment about the first axis, and a driven gear which surrounds the first axis and which is disposed downstream of said driving gear and adjacent to said coupling sleeve to deliver a reduction drive as a result of drive transmission from said driving gear to said driven gear;

a clutch member disposed to connect said coupling sleeve and said driven gear when said coupling sleeve is in the disengaging position so as to drive said coupling sleeve to rotate about the first axis with a second rotational drive, and to disconnect said coupling sleeve and said driven gear when said coupling sleeve is in the engaging positions;

a drive delivering sleeve having a spline segment which is disposed to be in spline engagement with said coupling sleeve, and a delivering segment which is disposed distal from said coupling sleeve, said drive delivering sleeve being sleeved on and being rotatable relative to said rotatable shaft about the first axis such that the first and second rotational forces are delivered through said spline segment to rotate said delivering segment about the first axis;

a drive transmitting member disposed to transmit a rotational force of said delivering segment to said rolling member; and a shifting member disposed to shift said coupling sleeve between the engaging and disengaging positions.

2. The wood planing device of claim 1, wherein said delivering and spline segments are disposed opposite to each other and distal from and proximate to said inner surrounding coupling segment, respectively, said coupling sleeve further having an inner surrounding splining segment which is disposed opposite to said inner surrounding coupling segment in the longitudinal direction, and which is in spline engagement with said spline segment.

3. The wood planing device of claim 2, wherein said clutch member includes a plurality of engaging protrusions which are formed on said coupling sleeve and which extend away from said inner surrounding splining segment in the longitudinal direction, and a plurality of engaging recesses which are formed in said driven gear and which confront said engaging protrusions so as to engage retainingly said engaging protrusions when said coupling sleeve is in the disengaging position.

4. The wood planing device of claim 1, wherein said shifting member includes an actuating unit which has an inner actuating end rotatably mounted in said support carriage about an operating axis radial to the first axis of said rotatable shaft, and an outer operating end extending from said inner actuating end along the operating axis and outwardly of said support carriage so as to be externally operable to rotate said inner actuating end with a rotating force, and a cam unit disposed to convert the rotating force of said inner actuating end of said actuating unit into a translational force for moving said coupling sleeve along the first axis between the engaging and disengaging positions.

5. The wood planing device of claim 4, wherein said cam unit includes a driving pinion disposed to be rotated with said inner actuating end about the operating axis, a transmission lever having a rack segment which is meshed with said driving pinion to move said transmission lever in the longitudinal direction when said driving pinion is rotated with said inner actuating end, and a connecting end which is disposed opposite to said rack segment in the longitudinal direction, and a coupler disposed to couple said connecting end with said coupling sleeve so as to move said coupling sleeve along the first axis when said transmission lever is moved in the longitudinal direction.

6. The wood planing device of claim 5, wherein said coupler includes a connecting ring sleeved securely on said coupling sleeve, a flange disposed to extend outwardly and radially from said connecting ring, and an actuated plate having a sleeve end which is sleeved on said connecting ring and which abuts against said flange in the longitudinal direction, and a coupling end extending from said sleeve end in a direction radial to the first axis so as to couple with said connecting end of said transmission lever.

7. The wood planing device of claim 1, wherein said reduction gear train further includes a larger gear and a smaller gear which are coupled coaxially to each other along a third axis parallel to the first axis and which are meshed with said driving gear and said driven gear, respectively, so as to result in the reduction drive, and first and second bearing seats which are disposed opposite to each other in the upright direction, said driving and driven gears being rotatably accommodated in said first bearing seat, said larger and smaller gears being rotatably accommodated in said second bearing seat.

8. The wood planing device of claim 1, wherein said rolling member includes feed-in and take-out rollers disposed parallel to each other in the longitudinal direction and adapted to be proximate to the feed-in and take-out sides, respectively.

* * * * *